United States Patent [19]

Eiermann

[11] Patent Number: 4,464,102

[45] Date of Patent: Aug. 7, 1984

[54] EXTERNAL AXIS ROTARY PISTON COMPRESSOR

[75] Inventor: Dankwart Eiermann, Weissensberg, Fed. Rep. of Germany

[73] Assignee: Wankel GmbH, Berlin, Fed. Rep. of Germany

[21] Appl. No.: 383,313

[22] Filed: May 28, 1982

[30] Foreign Application Priority Data

May 29, 1981 [DE] Fed. Rep. of Germany ..... 3121269

[51] Int. Cl.[3] ..... F04C 18/08

[52] U.S. Cl. ..... 418/179; 418/188; 418/19

[58] Field of Search ..... 418/185, 188, 191, 179, 418/187, 189

[56] References Cited

U.S. PATENT DOCUMENTS

| | | | |
|---|---|---|---|
| 1,640,727 | 8/1927 | Scott | 418/179 |
| 2,690,869 | 10/1954 | Brown | 418/185 X |
| 2,829,925 | 4/1958 | Monteil | 418/191 X |
| 3,182,900 | 5/1965 | Thorson | 418/191 X |
| 3,304,838 | 2/1967 | McDonald | 418/152 |
| 3,472,445 | 10/1969 | Brown | 418/189 |
| 3,601,514 | 8/1971 | Afner | 418/188 |

*Primary Examiner*—John J. Vrablik
*Assistant Examiner*—Theodore W. Olds
*Attorney, Agent, or Firm*—Becker & Becker, Inc.

[57] ABSTRACT

An external axis rotary piston compressor having a housing formed with at least two overlapping, parallel-axis cylindrical inner chambers each having a shaft passing therethrough. On the one shaft there is a cylindrical working rotor forming an annular working chamber with the housing wall surrounding the same, and including a shutoff tooth or projection. On the other shaft, which rotates counter thereto, there is provided a cylindrical shutoff rotor which runs along the housing wall and rides on the working rotor; this shutoff rotor includes a recess for engagement-free passage of the shutoff tooth or projection therethrough. The body of the working rotor is a hollow cylinder; when the hollow cylinder rotates, a port or control opening provided in the shutoff tooth or projection coincides with a further port or control opening located in a stationary sleeve arranged in the hollow cylinder, which is mounted in a first side part of the housing and is rigidly and coaxially connected with the drive shaft mounted in the other side part. An inlet opening is provided for the working gas into the suction chamber in the rearward side of the hollow shut-off tooth or projection as seen in the direction of rotation of the working rotor. An outlet passage extending essentially tangential to the direction of movement of the working rotor conveys working gas.

18 Claims, 18 Drawing Figures

360°

30°

40°

50°

230°

300°

310°

330°

23
28
47
48
46
15
45
230°

23
28
47
48
15
300°

47
48
310°

47
48
330°

EXTERNAL AXIS ROTARY PISTON COMPRESSOR

The present invention relates to an external axis rotary piston blower, compressor or superchargers having a housing formed with at least two overlapping, parallel-axis cylindrical inner chambers, each having a shaft passing therethrough. On one shaft there is a cylindrical working rotor which is provided with a shutoff tooth or projection, and which forms an annular working chamber with the housing wall surrounding it. On the other shaft, which rotates in the opposite direction, there is provided a cylindrical shutoff rotor which runs along the housing wall and rides on the working rotor; this shutoff rotor has a recess for the passage of the shutoff tooth or projection therethrough without contacting it. The body of the working rotor is a hollow cylinder; when the hollow cylinder rotates, a port or control opening provided in the shutoff projection or projections coincides with a further port or control opening which is located in a stationary sleeve arranged in the hollow cylinder.

Such machines, compared with other small blowers or compressors, among which, as the most often used types, are included Roots-type blowers or compressors and helical compressors developed therefrom, have the advantage that no rotor contours or shapes formed out of cycloids are necessary. Additionally, advantageous compression diagrams are attainable with such machines. Such a blower or compressor is described in U.S. Pat. No. 2,130,054—Whitfield, issued Sept. 13, 1938, with which the working rotor has two or three shutoff teeth or projections, and correspondingly has two or three shutoff rotors associated therewith. The stationary sleeve, about which the hollow cylinder, which represents the body of the working rotor, rotates, forms an annular chamber through which the drive shaft passes. The working rotor and the shutoff rotor roll on each other by means of gearing interrupted by the shutoff teeth or projections, which cooperate in a gear-like manner with the recesses of the shutoff rotor, though otherwise having the entire axial surface occupied by teeth, so that no synchronous drive or transmission is needed.

German Offenlegungsschrift No. 22 22 500 describes another machine with which only one shutoff tooth or projection and only one shutoff rotor are provided and driven in opposite directions by a transmission with a 1:1 ratio. This avoids a direct gear-tooth system of the rotors, which during production causes difficult, expensive, and considerable frictional resistances, and output losses due to squish or compressive flows between the teeth.

Both constructions have a disadvantageous, complicated flow path of the working gas, especially during the exhaust or discharge thereof. The working gas in both situations is drawn in through circumferential inlets, is guided inwardly through the working rotor past deflections, and is then exhausted or pushed-out axially. There was proceeded on the basis of the obvious prejudice that for the compressed gas smaller flow cross sections were needed. There has, however, been shown that with such gas guidance, pressure fluctuations arise in the annular working chamber as a result of pressure buildup. Such pressure fluctuations cause a considerably great drop in efficiency, which precludes a practical utilization of such machines in most situations.

Additionally, both aforementioned solutions are not suitable for inexpensive, small, mass produced compressors needed as superchargers or compressors in the motor vehicle industry. A further disadvantage is also encountered, leakage path is possible via the gaps between the shutoff rotor and the housing side walls at the part thereof engaging or fitting into the annular working chamber after passage of the shutoff tooth or projection through the recess of the shutoff rotor. Because it is so short, this leakage path can be especially effective, so that consequently the axial play of the shutoff rotor must be kept very small. A greater construction on cost is consequently required in order to keep this leakage path as small as possible, and on the other hand to avoid having the shutoff rotor contact the housing side walls.

It is an object of the present invention to avoid the described flow hindrances from pressure buildup and pressure fluctuations, as well as output or capacity losses resulting therefrom, and further to avoid the leakage paths between the housing side walls and the shutoff rotor while allowing a greater axial play of this rotor, yet to provide a very simple and correspondingly inexpensive overall construction.

This object, and other objects and advantages of the present invention, will appear more clearly from the following specification in connection with the accompanying drawings, in which.

Figure 1:
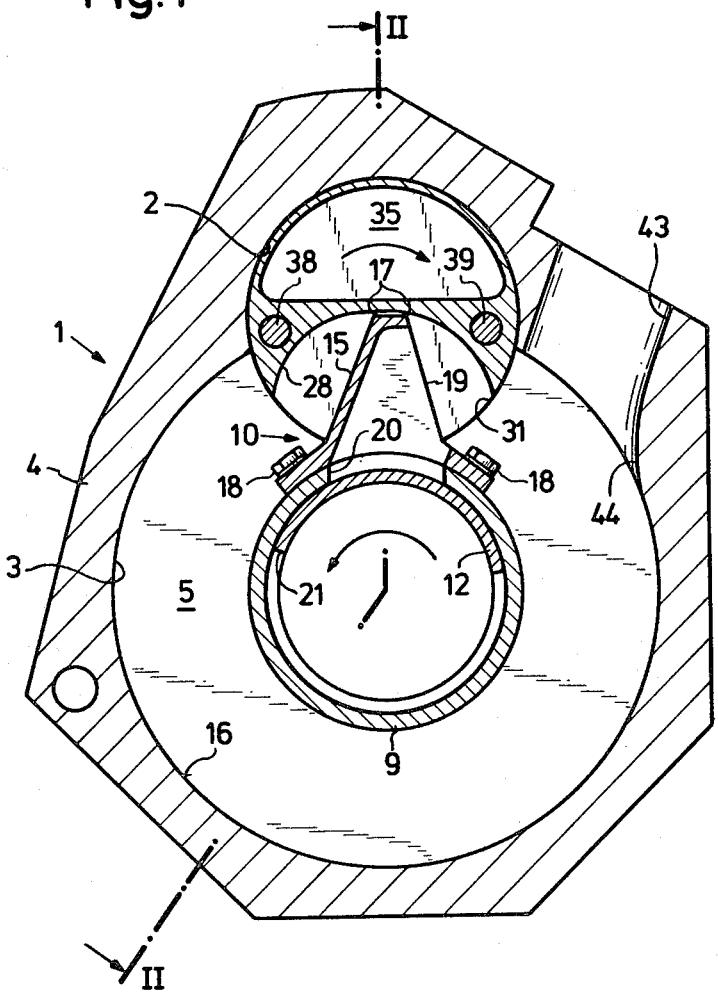
FIG. 1 is a radial section through one embodiment of the inventive rotary piston blower or compressor in a plane taken along line I—I in FIG. 2.
Figure 4:
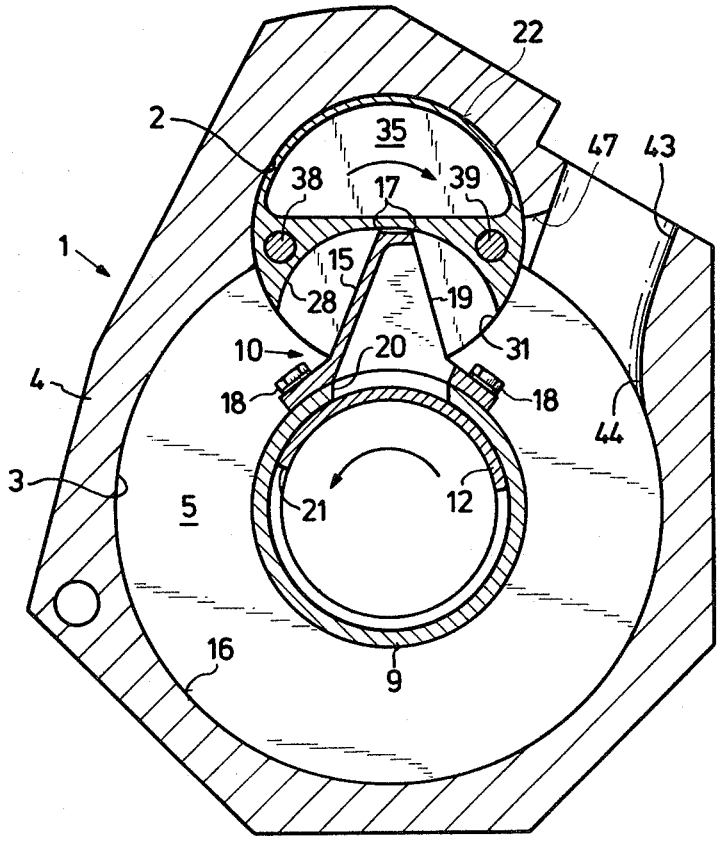
Figures 5A, 5B, 5C, 5D:
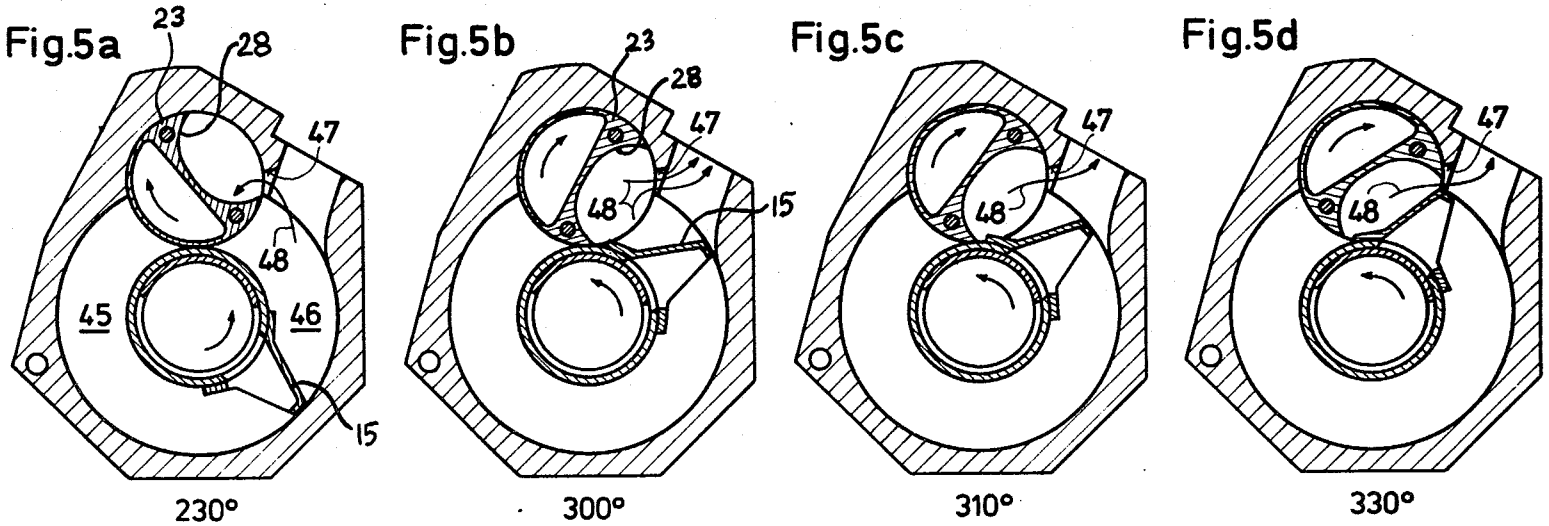
Figure 6:
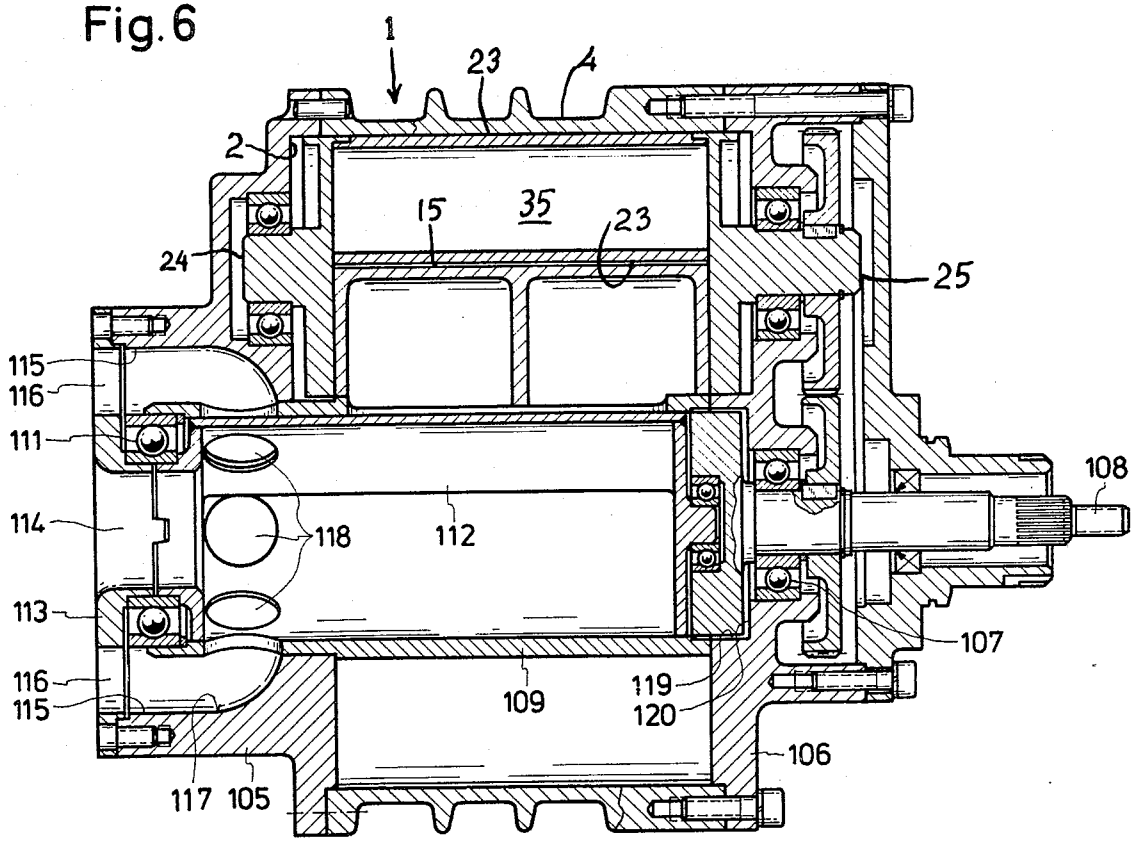
Figure 7:
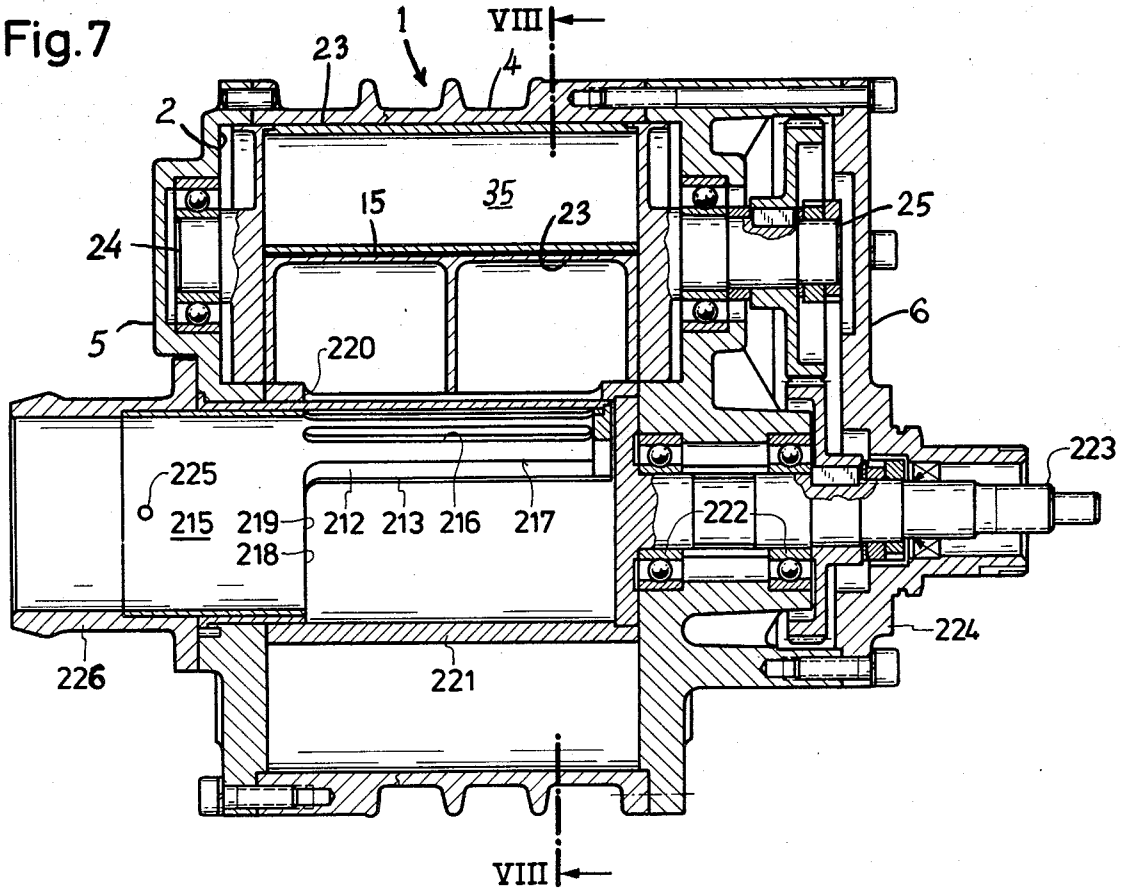
Figure 8:
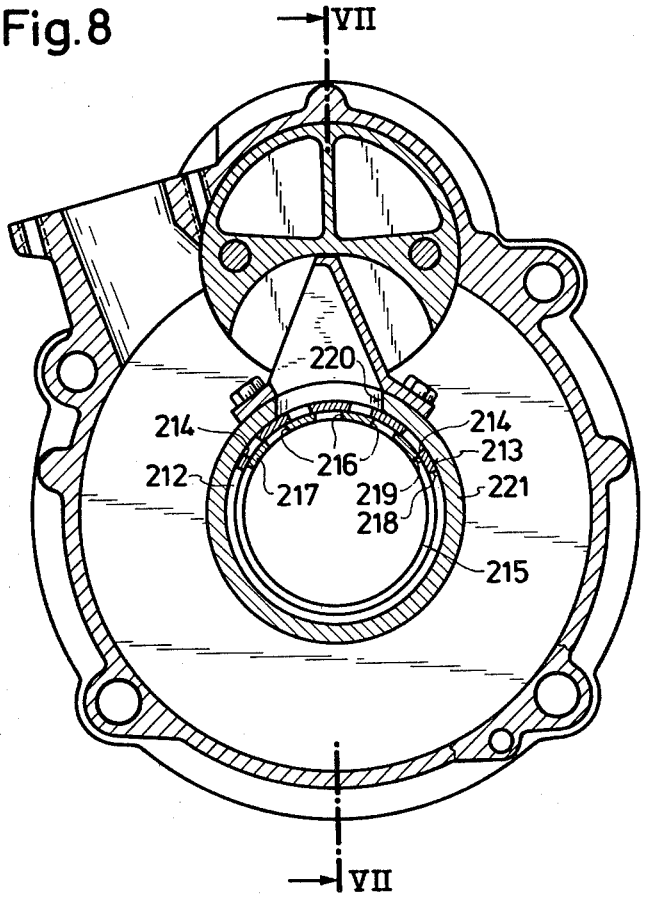

FIGS. 3*a*–3*h* show eight schematic radial sections of the same compressor in different sequential phases of movement;

FIG. 4 is a radial section similar to that in FIG. 1, though illustrating a connecting passage between the outlet passage and the recess in the shutoff rotor;

FIGS. 5*a*–5*d* schematically illustrate four radial sections of the compressor of FIG. 4 in different sequential phases of movement;

FIG. 6 illustrates another embodiment of the inventive rotary piston compressor in an axial section;

FIG. 7 illustrates a further embodiment of the compressor according to the present invention in an axial section taken a in a plane along line VIII—VIII in FIG. 8; and FIG. 8 is a radial section through the compressor illustrated in FIG. 7 taken in a plane along line VII—VII.

The compressor of the present invention is characterized primarily in that the hollow cylinder is mounted or journalled in a first side part of the housing, and is rigidly and coaxially connected with the drive shaft which is mounted or journalled in the other side part of the housing; furthermore, the sleeve, which is stationary in the first side part, is sealingly surrounded by the hollow cylinder, and is provided with the further port, which provides its entire inner chamber an inlet passage for the drawn-in air or working gas; in that side of the hollow shutoff tooth or projection which is in the rear, as seen in the direction of rotation of the working rotor, there is provided an inlet opening into the suction chamber for the working gas; and in that an outlet passage is provided in the casing of the housing for the conveyed working gas; such outlet passage essentially extending in a direction tangential to the direction of movement of the working rotor.

A considerably lower power consumption of the compressor results, yet with the same working gas throughput or the same compression, via the inventive reversal of the flow direction compared with the known types of blowers or compressors as well as the additionally mentioned features for improvement of flow guidance. The pressure fluctuations in the annular working chamber which hinder the flow, and the energy consuming turbulence generated by the reversal of the exhaust flow, are avoided with the construction according to the present invention. A special advantage is the arrangement of the exhaust in the circumference of the casing, as a result of which the centrifugal forces effective upon the working gas can be utilized, against which centrifugal forces therefore the working gas had to be pushed out with the previously known constructions. The energy saving obtained is equally as decisive for the utilization of such compressors as is the inexpensive fabrication made possible by the construction according to the present invention.

According to specific embodiments of the present invention, the shutoff rotor in its axial extension of dimension, extends into bores or recesses in the side parts; these parts are fitted with the cylindrical surface of the shutoff rotor so as not to contact it, yet forms an extremely narrow gap relative thereto.

The transition from the casing path, course, or raceway into the outlet passage may be rounded off.

An intermediate layer of a material having a high slide capability or low frictional coefficient may be placed between the hollow cylinder and the sleeve, such intermediate layer sealingly filling out the gap or space between the hollow cylinder and the sleeve.

The shutoff tooth or projection may be made of aluminum, and the hollow cylinder may be made of steel; the shutoff tooth or projection is counterbalanced by removal of material to form the control opening or port in the hollow cylinder.

The casing and one side part may be unitary or integral with each other; the cylindrical inner chambers in the casing, as well as the bores or recesses in the side parts for the shutoff rotor, may be made by circular milling.

The shutoff tooth or projection, on its closed side, on the inner wall and also the outer wall thereof, forms an angle of 20° to 30° in a radial section with respect to its radial central axis.

A better volumetric efficiency, especially at high speeds, and in particular of approximately 20% to 30%, and a corresponding improvement in efficiency, can be achieved in that a connecting passage is provided in that wall of the cylindrical chamber, in which the shutoff rotor rotates, facing the outlet passage; the connecting passage leads from this cylindrical chamber to the outlet passage, and has an axial length of approximately 80 to 90% of the length of the shutoff rotor; the connecting passage widens toward the outlet passage, and is open toward the cylindrical chamber in which the working rotor rotates.

At high speeds, where the hollow cylinder of the working rotor can no longer be mounted or journalled in an external bearing, which was necessary in order to have the entire cross section of the hollow cylinder available as an inlet opening, an equally large inlet flow or intake cross section for the working gas can be obtained by arranging an inner bearing in the hollow cylinder. In particular, the hollow cylinder is mounted or journalled in an inner bearing in the outer flange in the first side part; a central opening is provided in the outer flange for the drawn-in working gas, and a plurality of lateral openings for the working gas can surround this central opening, with these lateral openings being separated by the inner bearing and webs, which support the sleeve; and an annular chamber is formed in the first side part and surrounds the inner bearing, with the lateral openings communicating with openings in the wall of the hollow cylinder by means of this annular chamber.

Furthermore, the sealing of the working chambers relative to each other, and the sealing of the exhaust chambers, which are under pressure, can be improved by providing the right side wall with a bore or recess which is coaxial with respect to the shaft, and in which a cylindrical extension of the hollow cylinder fits without contact and is coaxial with respect to this recess; the fitting of this extension in the recess is tighter in the radial direction than in the axial direction.

In order to be able to improve the delivery pressure or the delivery volume of the working gas at higher speeds, it is proposed to construct the sleeve in such a manner that a plurality of axially directed slots are provided in that part of the sleeve which shuts off the port or control opening of the hollow cylinder; and that the sleeve surrounds a further sleeve which is rotatable externally, at random, about its longitudinal axis; this further sleeve has a port or control opening corresponding to the port or control opening in the first stationary sleeve, and has axial slots in the shutoff part thereof which corresponds to the shutoff part of the first sleeve; these axial slots, during rotation of this further sleeve, coincide with or shut off the slots of the first sleeve.

It has been found that as a preferred embodiment, three equally wide slots are arranged equidistantly in the sleeve, with the center line of the slots having a spacing of 34° from each other.

Figure 2:
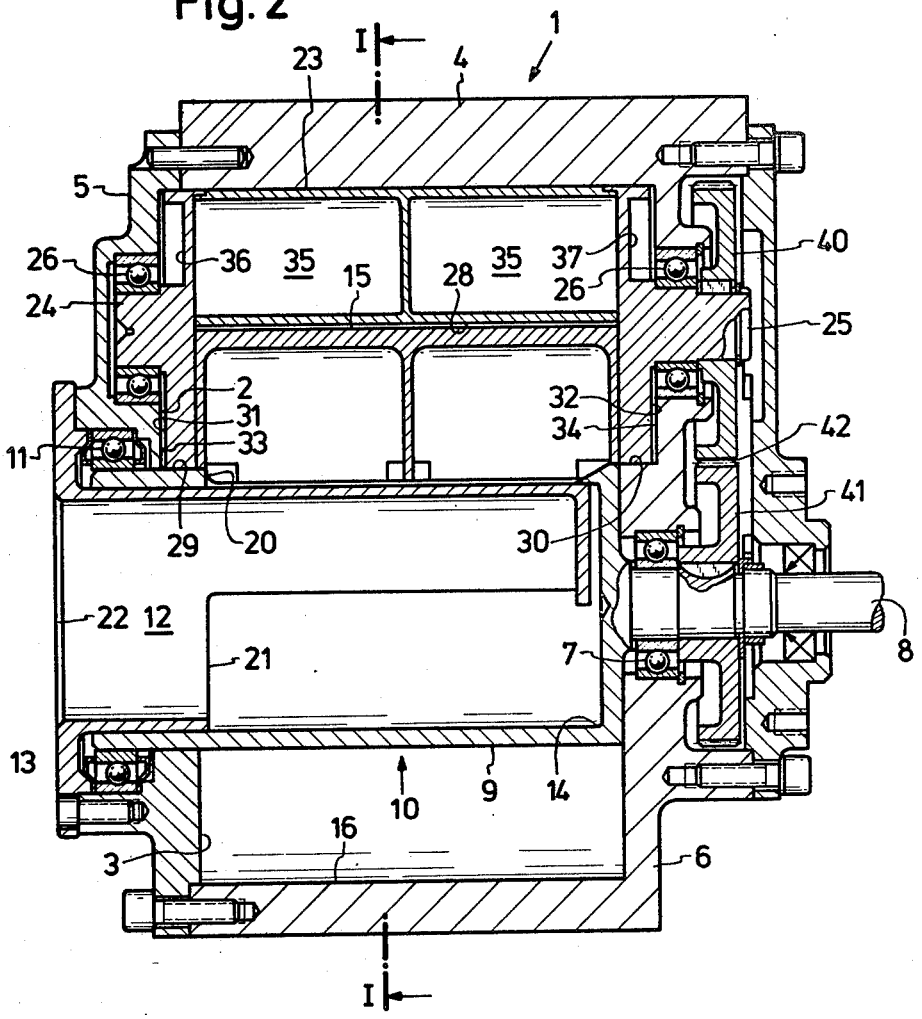
FIG. 2 is an axial section taken through the same compressor in a plane taken along line II—II in FIG. 1.
Figure 3A:
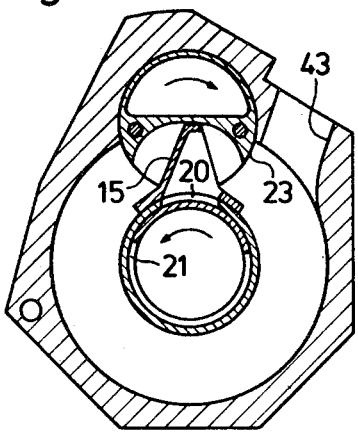
Figure 3B:
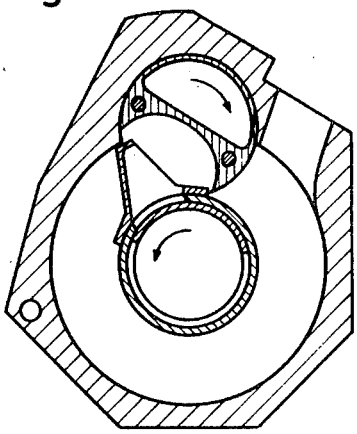
Figure 3C:
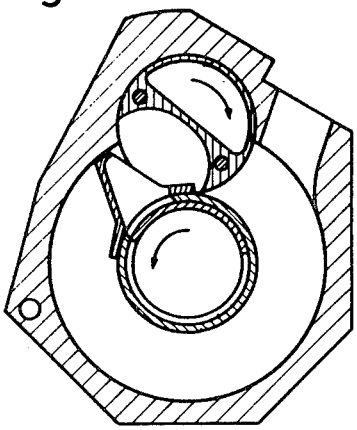
Figure 3D:
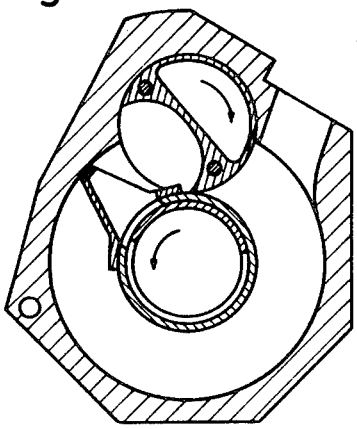
Figure 3E:
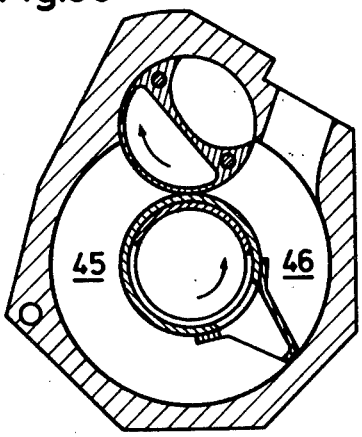
Figure 3F:
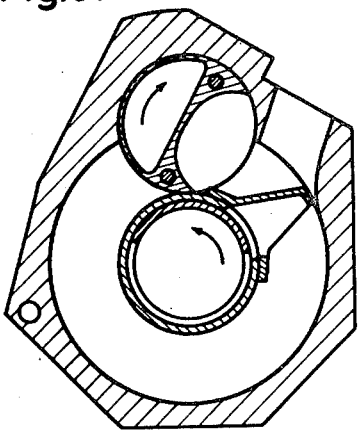
Figure 3G:
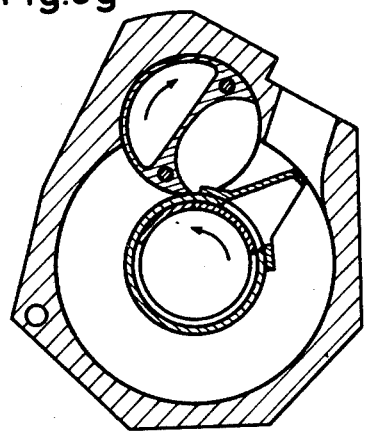
Figure 3H:
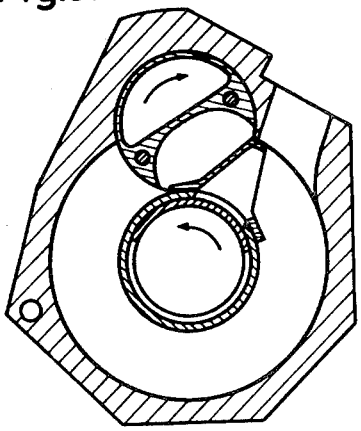

Referring now to the drawings in detail, the compressor, blower, or supercharger illustrated in FIGS. 1, 2 and 3 has a housing 1 which comprises two overlapping, parallel-axis cylindrical chambers 2 and 3 which are formed by a casing 4 and side parts 5 and 6, with the side part 6 being unitary or integrally connected with the casing 4 of the housing 1. A drive shaft 8 journalled in a ball bearing 7 in the right side part 6 projects axially and concentrically into the larger space or chamber 3. A hollow cylinder 9 which is coaxial with the drive or main shaft 8 is welded thereto in the interior of the chamber 3; the hollow cylinder 9 forms the body of the working rotor 10. This hollow cylinder 9 is mounted externally at its left end on a further ball bearing 11 which is arranged in the side part 5. A sleeve or bushing 12 having an outer flange 13 is screwed or bolted in the same side part 5; the sleeve or bushing 12 projects coaxially into the cylinder 9 to nearly the end thereof. A coating 14 of material having low friction properties, for instance tetrafluoroethylene (TFE), is provided on the inner side of the hollow cylinder 9; the coating 14, shown in FIG. 2, slidably and sealingly contacts the sleeve or bushing 12 and completely fills the gap between the hollow cylinder 9 and the sleeve or bushing 12. A shutoff tooth or projection 15 is screwed or bolted to the hollow cylinder 9, together with which it forms the working rotor 10. The edges 17 of the shutoff projection 15 runs along the path, raceway, or course 16 of the casing 4 without making contact therewith, but forming a very small gap.

The working or shutoff tooth or projection 15 is fastened to the hollow cylinder 9 with screws or bolts 18 as shown in FIG. 1. The rear side of the shutoff tooth or projection 15, as viewed in the direction of rotation, is provided with an inlet opening 19 for the entry of working gas into the chamber 3. The inlet opening 19 occupies the entire available axial width and radial height of the working or shutoff tooth or projection 15. A port or control opening 20 is provided in the hollow cylinder 9 and occupies the entire base of the inner space or chamber of the shutoff tooth or projection 15. This port 20 is adapted to coincide with a further port or control opening 21 in the sleeve or bushing 12 during the induction or intake stroke. The port 21 has the same axial width as the port 20 in the hollow cylinder 9, and has a span in the circumferential direction of 40° to 325° in the upper dead center position of the working rotor 10, i.e. the position illustrated in FIG. 1. The open, left side of the sleeve or bushing 12 in FIG. 1 is the inlet 22 for the working gas; an intake or suction connection can be arranged at this location.

A shutoff rotor 23 is coaxially arranged in the smaller cylindrical working chamber 2; the rotor 23 runs along the casing path, course, or raceway of the chamber 2 with very little play. The rotor 23 has the same radial diameter as the hollow cylinder 9, and rolls thereon. The shutoff rotor 23 is mounted or journalled via shaft ends 24, 25 in ball bearings 26, 27 in the side parts 5, 6. The shutoff rotor 23 has a recess 28, which in radial cross section forms a sector or circular arc, for the passage or movement of the shutoff tooth or projection 15 therethrough. The chamber 2 has an axially greater dimension than does the chamber 3. The side parts 5 and 6 have corresponding bores or recesses 20, 30 into which the shutoff rotor 23 projects laterally. The purpose thereof is to attain a better sealing. The cylinder wall of the shutoff rotor 23, and the recesses 29 and 30, can be adjusted much more accurately to a very narrow gap than the necessary play between the side walls 31 and 32 of the shutoff rotor 23, and the counter surfaces 33, 34 of the recesses 29, 30, would permit. This axial play can therefore be that of commercially available ball bearings, i.e. approximately 0.5 mm.

The shutoff rotor 23, for balancing thereof, has hollow chambers 35, as well as recesses 36, 37 on the side walls 31, 32 thereof, on that side located opposite the recess 28. Connecting rods or tension rods are provided at 38 and 39. The shutoff tooth or projection 15, which is cast of aluminum, need not be counter balanced, since its weight corresponds to the weight of the material (steel) of the hollow cylinder 9 which is removed for producing the port 20.

The drive or main shaft 8 of the working rotor 10, and the shaft end 25 of the shutoff rotor 23, are operatively connected by a transmission or gear unit 42 comprising two gears 40, 41 in a ratio of 1:1.

The outlet passage 43 for the working gas is arranged in the casing 4 directly ahead of the intersection of the cylindrical chambers 2 and 3. The axis of the outlet passage 43 extends or is directed tangentially relative to the direction of rotation of the working rotor 10 in order to allow an unhindered exhaust of the working gas without significant change of direction. For this purpose, the transition from the path, course, or raceway 16 to the outlet passage 43 is also rounded-off (at 44) in order to avoid a turbulence-forming edge.

The position illustrations of FIGS. *3a–3h* show the manner of operation of the compressor as follows:

In FIG. *3a*, the preceding exhaust of the working gas has been completed, and in FIG. *3b* the intake stroke begins, with opening of the port or control opening 21 in the sleeve or bushing 12, through the port or control opening 20 in the shutoff tooth or projection 15, with the port 20 rotating over the port 21; the shutoff rotor 23 divides the annular working chamber into a suction chamber 45, and an exhaust chamber or compression chamber 46. FIGS. *3h*, *3a* and *3b* show the passage of the shutoff tooth or projection 15 through the shutoff rotor 23, whereby as a consequence of the acute-angled tooth or projection shape, and the narrow radial approach surface of the shutoff tooth or projection, no squish or compressive flows can occur in the working gas.

A smooth flow pattern results with this arrangement and in this direction of rotation of the compressor, with build-up effects and pressure fluctuations being avoided, and with the centrifugal forces which act on the exhausted or pushed-out gas as a result of the tangential direction of the outlet passage 43 being utilized. Intake throttling is avoided through the size of the inlet openings 22, 21, 20 and 19.

When higher speeds are desired, the circumferential span of the port or control opening 21 in the sleeve or bushing 12 can be correspondingly lengthened, though the best results are attained with the stated values of 40° to 325°.

The described embodiment is very simple to make, and is extremely inexpensive to produce by mass production. All parts running along or engaging one another have the shape of sectors or arcs of circles, which makes possible a simple production by boring and circular milling, and which additionally permits a very accurate fitting for interengagement. The shutoff tooth or projection 15 is a simple casting. The axial play or clearances require no special tolerances, and finally the relationship between the efficiency and the throughput or volume handled is much more advantageous than with the known approaches.

A connecting passage 47 between the outlet passage 43 and the chamber 2, or the recess 28 in the shutoff rotor 23, is illustrated in FIG. 4. The manner of operation is apparent from the illustrations of FIGS. *5a*, *5b*, *5c* and *5d*. The arrows 48 show the direction of flow of the working gas in the individual phases of movement. As a result of the arrangement of this connecting passage 47, there is brought about at high speed that the pressure of the working gas is affected when passing into the recess 28 in the position in FIG. *5a*, in the following positions according to FIGS. *5b*, *5c*, and *5d* as the working gas is conveyed into the outlet passage 43; consequently, the working gas encounters a complete relief of the pressure, and thus the working gas does not flow over into the following suction chamber.

FIG. 6 shows a left side part 105 in which the hollow cylinder 109 rotates in an inner bearing 111 against the sleeve or bushing 112. An outer flange 113 is arranged on the side part 105, and has a central opening 114 for the working gas, as well as lateral openings 115, between which webs 116 are provided for supporting the inner bearing 111. The sleeve or bushing 112 is fastened to the stationary part of this bearing, and the hollow cylinder 109 is fastened to the movable part of the bearing.

An annular chamber 117 is furthermore provided in the side part 105, through which the working gas entering at the lateral inlet openings 115 passes through the openings 118 into the hollow cylinder 109 according to FIG. 6. This arrangement is necessary at high speeds since an outer bearing with the diameter as shown in FIG. 2 would be overloaded. The reduction of the cross section of the inlet opening into the hollow cylinder 109 by means of the inner bearing 111 is balanced by the described features.

FIGS. 7 and 8 show the arrangement of an inner control. The sleeve or bushing 212, which in the shutoff part 213 thereof has three axially directed slots 214, surrounds a further sleeve 215 which is rotatable at random from the outside about its longitudinal axis, and which in turn has axially directed slots 216 in its shutoff part 217. Both sleeves have cooperating ports or control openings 218 and 219, and slots 214 and 216.

The slots 214 of the sleeve or bushing 212 are covered partially or entirely by rotating the sleeve 215, and the port or control opening 220 of the hollow cylinder 221 is not completely covered by the shutoff part 213 of the sleeve 212 during opening of the slots 214. Rotation of the sleeve 215 is effected with a pin arranged at 225, which engages through a slot in the outer flange 226 in the drawing of FIG. 7.

FIG. 8 shows a preferred embodiment with three slots 214 and three slots 216, whereby the axial center lines of the slots 214 are each 34° apart from each other.

FIG. 7 additionally shows an overhung journalling or mounting of the hollow cylinder 221 in a double bearing 222 of the shaft 223 in the right side part 224. Such a journalling is, however, only possible with short compressors where the length of the hollow cylinder 221 does not materially exceed the diameter thereof. Such an arrangement does not, however, depart from the scope of the teaching of the present invention.

It has been shown to be expedient that the shutoff tooth or projection 15, at the closed side thereof, both at the inner wall as well as the outer wall, in a radial section relative to its radial center axis, have an angle of 20° to 30°. Compression or squish flows are thereby avoided.

Tests have proven that with the mentioned angular range, the best flow ratios and efficiencies can be achieved.

The present invention is, of course, in no way restricted to the specific disclosure of the specification and drawings, but also encompasses any modifications within the scope of the appended claims.

What I claim is:

1. An external axis rotary pistion compressor comprising:

a housing having a first and second side part, and at least two overlapping, parallel-axis, cylindrical inner chambers, each having a respective shaft passing therethrough, said housing further being provided with an outlet passage, from said inner chambers, for conveyed working gas;

a cylindrical working rotor arranged on one of said shafts, which is associated with a drive shaft journalled in said second side part, with said outlet passage in said housing essentially extending tangential to the direction of movement of said working rotor; the body of said working rotor being a hollow cylinder mounted in said first side part and rigidly and coaxially connected with said drive shaft, said hollow cylinder being provided with a hollow shutoff projection which projects radially outwardly therefrom, said hollow cylinder being further provided with a first port which communicates the hollow interior of said hollow cylinder with the hollow interior of said shutoff projection; said working rotor forming an annular working chamber with that portion of said housing which surrounds it, said working chamber, when viewed in the direction of rotation of said working rotor, including a suction chamber behind said shutoff projection, with said shutoff projection being provided on its rear side with an inlet opening, into said suction chamber, for working gas;

a cylindrical shutoff rotor arranged on the other of said shafts, which turns in the opposite direction to the one of said shafts, said shutoff rotor running along the associated portion of said housing, and riding on said working rotor; said shutoff rotor being provided with a recess for passage of said shutoff projection therethrough without contacting said shutoff rotor; and a stationary sleeve fixed to said first side part and arranged in said hollow cylinder in such a way as to be sealingly surrounded thereby, said sleeve being provided with a second port which is adapted to coincide with said first port of said hollow cylinder when the latter rotates, said sleeve having an inner chamber which forms an inlet passage for drawn-in working gas, said first side part including an outer flange in which an inner bearing is mounted, said hollow cylinder being journalled in said inner bearing; said outer flange being provided with a central opening, and a plurality of lateral openings surrounding this central opening, for drawn-in working gas, said lateral openings being separated by said inner bearing and webs which support said sleeve; in which said hollow cylinder is provided with openings; and in which an annular chamber which surrounds said inner bearing is formed in said first side part, said lateral openings communicating with said openings, and thus with the hollow interior of said hollow cylinder, by means of said annular chamber.

2. A compressor according to claim 1, in which said first and second side parts of said housing are respectively provided with recesses for receiving the axial ends of said shutoff rotor in such a way that they do not contact the radial cylindrical surface of said shutoff rotor, but only form an extremely narrow gap relative thereto.

3. A compressor according to claim 1, in which said housing is rounded off at the transition from said inner chambers into said outlet passage.

4. A compressor according to claim 1, which includes an intermediate layer, of a material having low friction properties, placed and sealingly filling the gap between said hollow cylinder and said sleeve.

5. A compressor according to claim 1, in which said shutoff projection is made of aluminum, said hollow cylinder is made of steel, and said shutoff projection is counterbalanced by removal of material from said hollow cylinder to form said first port therein.

6. A compressor according to claim 2, in which said second side part is integral with said housing, and said cylindrical inner chamber, as well as said recesses in said side parts, are circular milled.

7. A compressor according to claim 1, which includes a connecting passage in that portion of said housing which is adjacent said outlet passage and which is provided with the inner chamber accommodating said shutoff rotor, said connecting passage communicating this inner chamber with said outlet passage, and having an axial length of approximately 80 to 90% of the length of said shutoff rotor; said connecting passage widens in the direction toward said outlet passage.

8. A compressor according to claim 1, in which that end of said hollow cylinder remote from said first side part is provided with a cylindrical extension, and in which said second side part is provided with a recess which is coaxial to said drive shaft and in which said cylindrical extension fits coaxially and without contact, with the fitting of said extension in said recess being tighter in the radial direction than in the axial direction.

9. A compressor according to claim 8, in which that part of said stationary sleeve which shuts off said first port of said hollow cylinder is provided with a plurality of axially directed slots; and which includes a further sleeve which is surrounded by said stationary sleeve and is externally rotatable, at random, about its longitudinal axis; said further sleeve being provided with a third port which corresponds to said second port of said stationary sleeve, and also being provided with axial slots in that part thereof which corresponds to the shutoff part of said stationary sleeve; said axial slots of said further sleeve, when the latter is rotated, being adapted to coincide with said axial slots of said stationary sleeve.

10. A compressor according to claim 8, which includes three equidistantly spaced slots of equal width in said stationary sleeve, the center lines of said slots being spaced 34° apart.

11. A compressor according to claim 1, in which that side of said shut-off projection remote from said inlet opening thereof extends at an angle which is 20° to 30° from the radial direction.

12. A compressor according to claim 1, in which said second port of said stationary sleeve has a circumferential span of 40° to 325°.

13. An external axis rotary piston compressor comprising in combination:

a housing having a first and second side part, and at least two overlapping, parallel-axis, cylindrical inner chambers, each having a respective shaft passing therethrough, said housing further being provided with an outlet passage, from said inner chambers, for conveyed working gas;

a cylindrical working rotor arranged on one of said shafts, which is associated with a drive shaft journalled in said second side part, with said outlet passage in said housing essentially extending tangential to the direction of movement of said working rotor; the body of said working rotor being a hollow cylinder mounted in said first side part and rigidly and coaxially connected with said drive shaft, said hollow cylinder being provided with a hollow shutoff projection which projects radially outwardly therefrom, said hollow cylinder being further provided with a first port which communicates the hollow interior of said hollow cylinder with the hollow interior of said shutoff projection; said working rotor forming an annular working chamber with that portion of said housing which surrounds it, said working chamber, when viewed in the direction of rotation of said working rotor, including a suction chamber behind said shutoff projection, with said shutoff projection being provided on its rear side with an inlet opening, into said suction chamber, for working gas;

a cylindrical shutoff rotor arranged on the other of said shafts, which turns in the opposite direction to the one of said shafts, said shutoff rotor running along the associated portion of said housing, and riding on said working rotor; said shutoff rotor being provided with a recess for passage of said shutoff projection therethrough without contacting said shutoff rotor; and a stationary sleeve fixed to said first side part and arranged in said hollow cylinder in such a way as to be sealingly surrounded thereby, said sleeve being provided with a second port which is adapted to coincide with said first port of said hollow cylinder when the latter rotates, said sleeve having an inner chamber which forms an inlet passage for drawn-in working gas;

said first and second side parts of said housing being respectively provided with recesses for receiving the axial ends of said shutoff rotor in such a way that they do not contact the radial cylindrical surface of said shutoff rotor, but only form an extremely narrow gap relative thereto;

an intermediate layer, of a material having low friction properties, placed and sealingly filling the gap between said hollow cylinder and said sleeve;

said shutoff projection being made of aluminum, said hollow cylinder being made of steel, and said shutoff projection being counterbalanced by removal of material from said hollow cylinder to form said first port therein;

said second side part being integral with said housing, and said cylindrical inner chamber, as well as said recesses in said side parts, being circular milled, that side of said shutoff projection remote from said inlet opening thereof extending at an angle which is 20° to 30° from the radial direction;

a connecting passage in that portion of said housing which is adjacent said outlet passage and which is provided with the inner chamber accommodating said shutoff rotor, said connecting passage communicating this inner chamber with said outlet passage, and having an axial length of approximately 80 to 90% of the length of said shutoff rotor; said connecting passage widening in the direction toward said outlet passage, said housing being rounded off at the transition from said inner chambers into said outlet passage.

14. A compressor in combination according to claim 13, in which that part of said stationary sleeve which shuts off said first port of said hollow cylinder is provided with a plurality of axially directed slots; and which includes a further sleeve which is surrounded by said stationary sleeve and is externally rotatable, at random, about its longitudinal axis; said further sleeve being provided with a third port which corresponds to said second port of said stationary sleeve, and also being provided with axial slots in that part thereof which corresponds to the shutoff part of said stationary sleeve; said axial slots of said further sleeve, when the latter is rotated, being adapted to coincide with said axial slots of said stationary sleeve.

15. A compressor in combination according to claim 14, which includes three equidistantly spaced slots of equal width in said stationary sleeve, the center lines of said slots being spaced 34° apart.

16. A compressor in combination according to claim 13, in which said second port of said stationary sleeve has a circumferential span of 40° to 325°, said hollow cylinder being journalled on one side together with said drive shaft.

17. A compressor in combination according to claim 13, in which said first side part includes an outer flange in which an inner bearing is mounted, said hollow cylinder being journalled in said inner bearing; said outer flange being provided with a central opening, and a plurality of lateral openings surrounding this central opening, for drawn-in working gas, said lateral openings being separated by said inner bearing and webs which support said sleeve; in which said hollow cylinder is provided with openings; and in which an annular chamber which surrounds said inner bearing is formed in said first side part, said lateral openings communicating with said openings, and thus with the hollow interior of said hollow cylinder, by means of said annular chamber.

18. A compressor in combination according to claim 13, in which that end of said hollow cylinder remote from said first side part is provided with a cylindrical extension, and in which said second side part is provided with a recess which is coaxial to said drive shaft and in which said cylindrical extension fits coaxially and without contact, with the fitting of said extension in said recess being tighter in the radial direction than in the axial direction.

* * * * *